US012152313B2

(12) United States Patent
Iseki

(10) Patent No.: US 12,152,313 B2
(45) Date of Patent: Nov. 26, 2024

(54) CYANIDE-BASED SILVER ALLOY ELECTROPLATING SOLUTION

(71) Applicant: EEJA LTD., Tokyo (JP)

(72) Inventor: Masato Iseki, Kanagawa (JP)

(73) Assignee: EEJA LTD., Tokyo (JP)

( * ) Notice: Subject to any disclaimer, the term of this patent is extended or adjusted under 35 U.S.C. 154(b) by 0 days.

(21) Appl. No.: 18/041,624

(22) PCT Filed: Aug. 17, 2021

(86) PCT No.: PCT/JP2021/030078

§ 371 (c)(1),
(2) Date: May 19, 2023

(87) PCT Pub. No.: WO2022/039171

PCT Pub. Date: Feb. 24, 2022

(65) Prior Publication Data

US 2023/0357945 A1 Nov. 9, 2023

(51) Int. Cl.
*C25D 3/64* (2006.01)

(52) U.S. Cl.
CPC ..... *C25D 3/64* (2013.01)

(58) Field of Classification Search
None
See application file for complete search history.

(56) References Cited

U.S. PATENT DOCUMENTS

| | | | | |
|---|---|---|---|---|
| 5,514,261 | A | 5/1996 | Herklotz et al. | |
| 7,887,692 | B2 | 2/2011 | Watanabe et al. | |
| 2007/0205109 | A1 | 9/2007 | Watanabe et al. | |
| 2011/0275175 | A1 | 11/2011 | Minsek et al. | |
| 2012/0097545 | A1* | 4/2012 | Imori | C23C 22/60 205/50 |

FOREIGN PATENT DOCUMENTS

| | | | | |
|---|---|---|---|---|
| GB | 2046794 | A * | 11/1980 | C25D 3/46 |
| JP | 07-252684 | A | 10/1995 | |
| JP | 4598782 | B2 | 12/2010 | |
| JP | 2011-231369 | A | 11/2011 | |
| JP | 2013-249514 | A | 12/2013 | |
| JP | 2014-139348 | A | 7/2014 | |
| JP | 2014-523653 | A | 9/2014 | |
| JP | 6230778 | B2 | 11/2017 | |
| JP | 2018-199839 | A | 12/2018 | |
| WO | 2013/016067 | A1 | 1/2013 | |

OTHER PUBLICATIONS

Bahmani et al., J Mater Sci '2021' 56:6427-6447 (Year: 2021).*
English translation of International Search Report mailed Sep. 14, 2021, in connection with PCT International Application PCT/JP2021/030078.
International Search Report mailed Sep. 14, 2021, in connection with PCT International Application No. PCT/JP2021/030078.
Written Opinion dated Sep. 14, 2021, in connection with PCT International Application No. PCT/JP2021/030078.

* cited by examiner

*Primary Examiner* — Wojciech Haske
(74) *Attorney, Agent, or Firm* — Norris McLaughlin, P.A.

(57) ABSTRACT

The present invention provides a cyanide-based silver alloy electroplating solution characterized by containing 10 to 100 g/L of silver cyanide complex in terms of silver, 5 to 300 g/L of electroconductive salt, 0.1 to 10 g/L of germanium compound in terms of germanium, and 1 to 100 g/L of a coordinating polymer additive.

4 Claims, No Drawings

CYANIDE-BASED SILVER ALLOY ELECTROPLATING SOLUTION

This application is a 371 application of PCT/JP2021/030078 filed Aug. 17, 2021, which claims foreign priority benefits under 35 U.S.C. § 119 of Japanese Application No. 2020-139007 filed Aug. 19, 2020, the disclosures of each of which are incorporated by reference herein in their entirety.

TECHNICAL FIELD

The present invention relates to a cyanide-based silver alloy electroplating solution. Specifically, the present invention relates to a silver-germanium alloy electroplating solution using a cyanide as a silver source to obtain a plating film having high hardness.

BACKGROUND ART

Since ancient times, silver has heavily been used for jewelry for its white luster. Silver is an inexpensive precious metal due to its relatively large amount of production, and therefore silver plating is performed even in modern times for the purpose of decoration of silver accessories and tableware. Further, silver has the highest electric conductivity at room temperature among all metals, and therefore silver plating is heavily used for lead frames and substrates for electronic devices such as ICs and transistors. Furthermore, silver has the highest visible-ray reflectance among all metals, and therefore in many cases, silver plating is performed on lead frames and various substrates for light-emitting devices typified by LEDs. In addition, silver plating is used for bearing parts and things utilizing the antibacterial activity of silver.

In recent years, electric and electronic parts have been required to have lower electric resistance, and therefore industrial demand for silver plating has increased. However, silver is a relatively soft metal, and therefore various attempts have been made to deposit a harder coating. For example, silver-antimony alloy plating is widely performed in which a silver coating is co-deposited with antimony. However, antimony is highly toxic to human bodies, and therefore restrictions on the use of antimony tend to become increasingly strict year by year. For this reason, there is demand for development of an alternative technique.

Patent Literature 1 discloses a silver plating solution containing a hardener and graphene oxide. As examples of the hardener for a silver coating, selenium, copper, tin, nickel, cobalt, tellurium, and bismuth as well as antimony are mentioned. However, there is no description about the hardness of a silver coating at the time when the hardener other than antimony is used.

Patent Literature 2 discloses a silver electroplating solution for optical semiconductor devices, which uses at least one of a selenium compound and a sulfur compound as an essential component in combination with a water-soluble compound of Ti, Zr, V, Mo, W, Co, Pd, Au, Cu, Zn, Ga, Ge, In, Sn, Tl, Sb, Bi, As, Te, Br, or I. However, the effect of such elements on the hardness of a plating film has not been examined at all.

Patent Literature 3 discloses a technique for improving the heat resistance of a palladium plating film by adding germanium to a palladium plating solution.

CITATION LIST

Patent Literatures

Patent Literature 1: JP 2018-199839 A
Patent Literature 2: Japanese Patent No. 6230778
Patent Literature 3: Japanese Patent No. 4598782

SUMMARY OF INVENTION

Technical Problem

Germanium has been studied as an alternative element to antimony as a silver coating hardener. High hardness can be expected by co-deposition of silver with germanium. Silver-germanium alloy plating solutions have been studied from a long time ago, but there is no industrially successful example. This is because it is not easy for a conventional technique to co-deposit silver with germanium, and therefore there is no technique of electrolytic plating capable of stably obtaining a lustrous appearance. For this reason, there is demand for the technique of silver-germanium alloy plating capable of sufficiently co-depositing germanium and obtaining a lustrous appearance.

It is therefore an object of the present invention to provide a silver-germanium alloy plating solution capable of forming a coating having performance comparable to or higher than that of a coating formed by silver-antimony alloy plating.

Solution to Problem

The present inventor has intensively studied, and as a result has found that germanium can be co-deposited at about several percentages in a silver coating by adding a germanium compound and a coordinating polymer additive to a silver electroplating solution so that a silver coating having a lustrous appearance and a high hardness can be obtained. This finding has led to the completion of the present invention. In order to achieve the above object, the present invention includes the following aspects.

[1] A cyanide-based silver alloy electroplating solution containing 10 to 100 g/L of a silver cyanide complex in terms of silver, 5 to 300 g/L of an electroconductive salt, 0.1 to 10 g/L of a germanium compound in terms of germanium, and 1 to 100 g/L of a coordinating polymer additive.

[2] The cyanide-based silver alloy electroplating solution according to [1], wherein the electroconductive salt contains at least one selected from among a cyanogen salt, a phosphate, a pyrophosphate, a nitrate, a citrate, a tartrate, a sulfate, and boric acid and a salt thereof.

[3] The cyanide-based silver alloy electroplating solution according to [1], wherein the germanium compound contains at least one selected from among germanium dioxide, germanium halide, tetraalkoxy germanium, germanium sulfide, and germanic acid and a salt thereof.

[4] The cyanide-based silver alloy electroplating solution according to [1], wherein the coordinating polymer additive is at least one selected from among polyacrylic acid, polyethyleneimine, and a copolymer containing them in a structure thereof.

Advantageous Effects of Invention

The cyanide-based silver alloy electroplating solution according to the present invention contains no antimony and makes it possible to obtain a silver-germanium alloy coating having a lustrous appearance and a high hardness. This makes it possible to provide electric contact materials whose demand is increasing due to the popularization of electric cars while dealing with environmental restrictions that have become increasingly strict year by year. Further, the thickness of a silver coating can be reduced, which is economically advantageous.

DESCRIPTION OF EMBODIMENTS

A silver electroplating solution according to the present invention contains a silver cyanide complex as a silver salt, an electroconductive salt, a germanium compound, and a coordinating polymer additive. Hereinbelow, each of the components of the silver electroplating solution according to the present invention will be described.

[Silver Cyanide Complex]

The cyanide-based silver alloy electroplating solution according to the present invention can use a known silver cyanide complex as a silver source without limitation. Examples of the silver cyanide complex include silver cyanide, silver potassium cyanide, and silver sodium cyanide.

The concentration of the silver cyanide complex is 10 to 100 g/L, preferably 20 to 70 g/L as a silver ion concentration. If the silver ion concentration is less than 10 g/L, there is a case where deposition efficiency reduces and a resulting silver coating cannot have a desired thickness. On the other hand, if the silver ion concentration exceeds 100 g/L, the amount of the silver salt to be lost by taking out of the plating solution by an object to be plated is large, which is economically disadvantageous.

[Electroconductive Salt]

The kind of the electroconductive salt contained in the cyanide-based silver alloy electroplating solution according to the present invention is not particularly limited as long as it has electric conductivity in an aqueous solution. The electroconductive salt preferably contains at least one selected from among a cyanogen salt, a phosphate, a nitrate, a citrate, a tartrate, a sulfate, and boric acid and a salt thereof to industrially stably use the electroconductive salt and economically produce the plating solution. In addition, a soluble organic acid salt is also preferred. These may be used singly or in combination of two or more of them. Examples of the cyanogen salt include potassium cyanide and sodium cyanide. Examples of the phosphate include potassium phosphate, sodium phosphate, and ammonium phosphate. Examples of the pyrophosphate include potassium pyrophosphate, sodium pyrophosphate, and ammonium pyrophosphate. Examples of the nitrate include potassium nitrate, sodium nitrate, and ammonium nitrate. Examples of the citrate include potassium citrate, sodium citrate, and ammonium citrate. Examples of the tartaric acid include potassium tartrate, sodium tartrate, and sodium potassium tartrate. Examples of the sulfate include potassium sulfate, sodium sulfate, and ammonium sulfate. Examples of the boric acid and the salt thereof include boric acid, sodium borate, and potassium borate.

The concentration of the electroconductive salt in the cyanide-based silver alloy electroplating solution according to the present invention is 5 to 300 g/L, preferably 50 to 250 g/L, more preferably 100 to 240 g/L. If the concentration of the electroconductive salt is less than 5 g/L, electric resistance of the plating solution is excessively high, and therefore plating cannot be performed at an appropriate cathode current density.

[Germanium Compound]

The germanium compound contained in the cyanide-based silver alloy electroplating solution according to the present invention is a compound containing germanium. Particularly, germanium dioxide, germanium halide, tetraalkoxy germanium, germanium sulfide, and germanic acid and a salt thereof are preferred. Examples of the germanate include sodium germanate and potassium germanate.

The concentration of the germanium compound in the cyanide-based silver alloy electroplating solution according to the present invention is 0.1 to 10 g/L, preferably 1 to 6 g/L as a germanium concentration. If the content of the germanium compound is out of the above concentration range, there is a case where a lustrous silver coating cannot be obtained or plating cannot be performed at an appropriate cathode current density.

[Coordinating Polymer Additive]

The coordinating polymer additive in the cyanide-based silver alloy electroplating solution according to the present invention is at least one selected from among polyacrylic acid, polyethyleneimine, and a copolymer containing them in a structure thereof, and is preferably polyacrylic acid or polyethyleneimine. The molecular weight of the coordinating polymer additive is not particularly limited, but the coordinating polymer additive generally has a number-average molecular weight of about 300 to 5000000.

The concentration of the coordinating polymer additive in the cyanide-based silver alloy electroplating solution according to the present invention is 1 to 100 g/L, preferably 2 to 84 g/L. If the concentration of the coordinating polymer additive is less than 1 g/L, there is a case where germanium cannot sufficiently be co-deposited. If the concentration of the coordinating polymer additive exceeds 100 g/L, there is a case where the viscosity of the plating solution excessively increases so that plating cannot be performed at an appropriate cathode current density or the amount of the plating solution to be taken out increases.

[Other Components]

In order to reduce viscosity to prevent unevenness of a silver coating, the cyanide-based silver alloy electroplating solution according to the present invention may contain, in addition to the above-described components, a component such as a surfactant without impairing the object of the present invention. Examples of the surfactant include an anionic surfactant such as sodium polyoxyethylene alkyl ether sulfate and a nonionic surfactant such as a polyoxyethylene alkyl ether condensate.

The cyanide-based silver alloy electroplating solution according to the present invention may contain neither a selenium compound nor a sulfur compound (except for germanium sulfide and the surfactant described above). Specifically, the cyanide-based silver alloy electroplating solution according to the present invention may contain neither a selenium compound such as potassium selenium cyanide, selenium cyanide, selenious acid, selenic acid oxide, or selenium oxide nor a sulfur compound such as carbon disulfide, thiourea, thiolactic acid, thiouracil, thiobarbituric acid, cysteine, cystine, thioacetic acid, or mercaptobenzothiazole.

The concentration of the selenium compound and the sulfur compound in the cyanide-based silver alloy electroplating solution according to the present invention is preferably less than 1 g/L, more preferably less than 0.1 g/L as a selenium concentration and a sulfur concentration. Even more preferably, the cyanide-based silver alloy electroplating solution according to the present invention contains substantially no selenium compound and sulfur compound (less than 0.01 g/L).

A solvent used for the cyanide-based silver alloy electroplating solution according to the present invention is water and may contain a water-based solvent (solvent dissolved in water at an added concentration).

The cyanide-based silver alloy electroplating solution according to the present invention can be produced by dissolving the above-described components in the solvent. The order of dissolving is not particularly limited. The cyanide-based silver alloy electroplating solution according to the present invention may be in a concentrated state (including a solvent-free state) during distribution or storage. Alternatively, the cyanide-based silver alloy electroplating solution according to the present invention may be distributed or stored without dissolving some of the components therein and used just after dissolving these components therein.

EXAMPLES

Hereinbelow, the present invention will specifically be described with reference to Examples. The present invention is not limited to these Examples.

As an object to be plated, a copper plate of 0.1 $dm^2$ was used. First, the copper plate was subjected to degreasing treatment using an alkaline degreasing solution and then neutralized with dilute sulfuric acid. Then, a matte copper coating of about 1.7 μm was formed in a cyanide bath. Then, a silver coating of about 0.1 μm was formed in a cyanide-based strike bath.

Plating solutions of Examples 1 to 12 and Comparative Examples 1 to 5 were prepared to have compositions shown in Tables 1 and 2 (in all of the plating solutions, the balance was water). The object to be plated was immersed in one liter of each of the prepared plating solutions, subjected to silver electroplating under conditions shown in Tables 1 and 2 until the thickness of a silver coating became 20 μm, washed with clean pure water, and then dried.

The thus obtained silver coatings of Examples 1 to 12 and Comparative Examples 1 to 5 were subjected to evaluation of appearance and measurement of hardness. The appearance herein is an appearance visually observed. The appearance was evaluated according to the following criteria: ○ The silver coating had a lustrous appearance without plating unevenness; and x The silver coating had an appearance other than the appearance evaluated as ○. The hardness herein is micro-Vickers hardness obtained by keeping a test force of 10 g for 10 seconds using an ultra-micro hardness tester MVK-H300 manufactured by Mitutoyo Corporation. The hardness was determined by performing measurement five times and averaging three measurement results other than the minimum value and the maximum value.

TABLE 1

| | | | Example 1 | Example 2 | Example 3 | Example 4 | Example 5 | Example 6 | Example 7 | Example 8 | Example 9 | Example 10 | Example 11 | Example 12 |
|---|---|---|---|---|---|---|---|---|---|---|---|---|---|---|
| Plating solution composition (g/L) | Silver cyanide complex | Silver potassium cyanide (in terms of Ag) | 20 | 20 | 30 | 40 | 50 | 60 | 60 | 40 | 40 | 40 | 40 | 40 |
| | Electro-conductive salt | Potassium cyanide | 120 | 120 | 150 | 150 | 200 | 220 | 220 | 180 | 180 | | 180 | 180 |
| | | Potassium phosphate | | | | 30 | | | | | | 100 | | |
| | | Potassium nitrate | | | | | 20 | | | | | 10 | | |
| | | Potassium citrate | | | | | | 20 | | | | 10 | | |
| | | Potassium tartrate | | | | | | | | 40 | | 10 | | |
| | | Potassium sulfate | | | | | | | | | 40 | 10 | | |
| | | Boric acid | | | | | 10 | | | | | 10 | | |
| | Germanium compound | Germanium dioxide (in terms of Ge) | 1.0 | 1.0 | 2.0 | 4.0 | 4.0 | 6.0 | | | | | 4.0 | 4.0 |
| | | Potassium germanate (in terms of Ge) | | | | | | | 6.0 | 4.0 | 4.0 | 4.0 | | |
| | Coordinating polymer additive | Polyacrylic acid | 2.0 | 2.0 | 4.0 | 6.0 | 4.0 | 4.0 | | | | 1.0 | 2.0 | 4.0 |
| | | Polyethylineimine | | | | | | 80 | 80 | 60 | 60 | 60 | 60 | 60 |
| Plating conditions | | Liquid temperature (° C.) | 25 | 25 | 25 | 25 | 25 | 25 | 25 | 25 | 25 | 30 | 30 | 30 |
| | | Current density (ASD) | 2 | 2 | 3 | 3 | 4 | 5 | 5 | 4 | 4 | 4 | 4 | 2 |
| | | Plating time (min) | 30 | 30 | 20 | 20 | 17 | 14 | 14 | 17 | 17 | 17 | 17 | 30 |
| Evaluations | | Appearance | ○ | ○ | ○ | ○ | ○ | ○ | ○ | ○ | ○ | ○ | ○ | ○ |
| | | Hardness (HV) | 180.40 | 188.20 | 187.30 | 180.50 | 182.50 | 184.60 | 188.00 | 184.70 | 182.70 | 185.30 | 183.70 | 184.20 |

TABLE 2

| | | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|
| Plating solution composition (g/L) | Silver cyanide complex | Silver potassium cyanide (in terms of Ag) | 60 | 30 | 60 | 60 | 60 | 60 | 60 |
| | Electroconductive salt | Potassium cyanide | 30 | | | | | | |
| | | Potassium phosphate | | 30 | | | | | |
| | | Potassium nitrate | | | 30 | | | | |
| | | Potassium citrate | | | | 30 | | | |
| | | Potassium tartrate | | | | | 30 | | |
| | | Potassium thiocyanate | | | | | | 10 | 50 |
| | | Potassium sulfate | | | | | | 10 | |
| | | Boric acid | | | | 10 | 10 | 10 | |
| | Germanium compound | Germanium dioxide (in terms of Ge) | 2.0 | 4.0 | | | 2.0 | 4.0 | |
| | | Potassium germanate (in terms of Ge) | | | 2.0 | 4.0 | | | 4.0 |
| | Additive | Propionic acid | | | | | 4.0 | | 4.0 |
| | | Ethylenediamine | | | | | | 60 | 60 |
| Plating conditions | | Liquid temperature (° C.) | 60 | 60 | 60 | 60 | 60 | 60 | 60 |
| | | Current density (ASD) | 50 | 70 | 70 | 70 | 50 | 50 | 70 |
| | | Plating time (min) | 8.0 | 5.7 | 5.7 | 5.7 | 8.0 | 8.0 | 5.7 |
| Evaluations | | Appearance | × | × | × | × | × | × | × |
| | | Hardness (HV) | 108.5 | 111.8 | 105.6 | 117.5 | 110.4 | 123.5 | 109.8 |

All of the silver coatings obtained in Examples 1 to 12 had a hardness of 180.0 or more. These silver coatings had a silver white color and an excellent appearance without unevenness. Bath stability was also excellent.

All of the silver coatings obtained in Comparative Examples 1 to 7 had a hardness of 130.0 or less. These silver coatings basically had a brown matte color and partially had a semilustrous appearance, and therefore the appearance thereof was poor due to unevenness. The hardness was measured in a semilustrous portion for convenience of measurement. Bath stability was excellent.

The invention claimed is:

1. A cyanide-based silver alloy electroplating solution containing 10 to 100 g/L of a silver cyanide complex in terms of silver, 5 to 300 g/L of an electroconductive salt, 0.1 to 10 g/L of a germanium compound in terms of germanium, and 1 to 100 g/L of a coordinating polymer additive.

2. The cyanide-based silver alloy electroplating solution according to claim 1, wherein the electroconductive salt contains at least one selected from among a cyanogen salt, a phosphate, a pyrophosphate, a nitrate, a citrate, a tartrate, a sulfate, and boric acid and a salt thereof.

3. The cyanide-based silver alloy electroplating solution according to claim 1, wherein the germanium compound contains at least one selected from among germanium dioxide, germanium halide, tetraalkoxy germanium, germanium sulfide, and germanic acid and a salt thereof.

4. The cyanide-based silver alloy electroplating solution according to claim 1, wherein the coordinating polymer additive is at least one selected from among polyacrylic acid, polyethyleneimine, and a copolymer containing them in a structure thereof.

* * * * *